US006138900A

United States Patent [19]

Zeiler

[11] Patent Number: 6,138,900

[45] Date of Patent: Oct. 31, 2000

[54] FLIP-UP TAB POUCH

[75] Inventor: George Zeiler, Centerville, Ohio

[73] Assignee: NCR Corporation, Dayton, Ohio

[21] Appl. No.: 09/198,294

[22] Filed: Nov. 23, 1998

[51] Int. Cl.[7] ..... B65D 27/22

[52] U.S. Cl. ..... 229/67.4; 40/359; 206/425

[58] Field of Search ..... 229/67.1, 67.2, 229/67.3, 67.4, 68.1; 206/425; 40/359; D19/3, 4

[56] References Cited

U.S. PATENT DOCUMENTS

| | | | |
|---|---|---|---|
| 783,365 | 2/1905 | Coleman | 229/67.4 |
| 947,218 | 1/1910 | MacGregor | 229/67.4 |
| 960,384 | 6/1910 | Norman | 229/68.1 |
| 972,045 | 10/1910 | Wingeier | 229/68.1 |
| 1,048,577 | 12/1912 | Pardoe, Jr. | 206/425 |
| 1,054,239 | 2/1913 | Probasco | 40/359 |
| 1,529,264 | 3/1925 | Mayers | 229/67.4 |
| 1,977,779 | 10/1934 | Southworth | 229/68.1 |
| 2,281,452 | 4/1942 | Ottinger | 229/68.1 |
| 2,792,981 | 5/1957 | Grammer | 229/68.1 |
| 2,945,616 | 7/1960 | Normandin | 229/68.1 |
| 3,073,508 | 1/1963 | Hiersteiner | 229/68.1 |
| 3,371,850 | 3/1968 | Gorman | 229/68.1 |
| 3,489,332 | 1/1970 | Knittel | 229/68.1 |
| 3,558,040 | 1/1971 | Krueger | 229/68.1 |
| 3,680,969 | 8/1972 | Gorman | 40/359 |
| 4,549,688 | 10/1985 | Ozmon et al. | 229/68.1 |
| 5,447,334 | 9/1995 | Hartsock | 40/359 |

*Primary Examiner*—Stephen P. Garbe
*Attorney, Agent, or Firm*—Francis L. Conte

[57] ABSTRACT

A storage pouch includes a panel integrally joined to a flap along a fold line. A tab is integrally joined to one of the panel and flap at the fold line for permitting flip-up pivotal movement of the tab for ready identification of the pouch.

21 Claims, 4 Drawing Sheets

FLIP-UP TAB POUCH

BACKGROUND OF THE INVENTION

The present invention relates generally to stationery products, and, more specifically, to packaging pouches.

Stationery products may be offered for sale in small volumes in corresponding pouches specifically configured therefor. A typical packaging pouch includes a rectangular panel and four integral flaps three of which are bonded together to form an inside pocket, with the fourth flap being used to close the pocket. This pouch is a form of envelope having an access flap which may be pivoted open for inserting inside the pocket one or more articles for packaging and storing therein.

For example, several sheets of pressure sensitive labels may be grouped together in the pouch during the manufacturing process, with the access flap being suitably secured or closed with a packaging tape or adhesive bond. The various exposed surfaces of the pouch have suitable printed information and graphics thereon for identifying and promoting the packaged product.

After purchase by a consumer, the access flap is opened to provide access to the label sheets therein which are typically removed individually as required, with the remaining sheets being stored for later use. The pouch may be stored in a filing cabinet drawer typically between files or folders therein. The pouch is therefore not visible except for its top edge, and its identity may not be apparent.

Accordingly, it is desired to improve the visible identity of the pouch when stored in a file cabinet drawer sandwiched among adjacent files or file folders therein.

BRIEF SUMMARY OF THE INVENTION

A storage pouch includes a panel integrally joined to a flap along a fold line. A tab is integrally joined to one of the panel and flap at the fold line for permitting flip-up pivotal movement of the tab for ready identification of the pouch.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
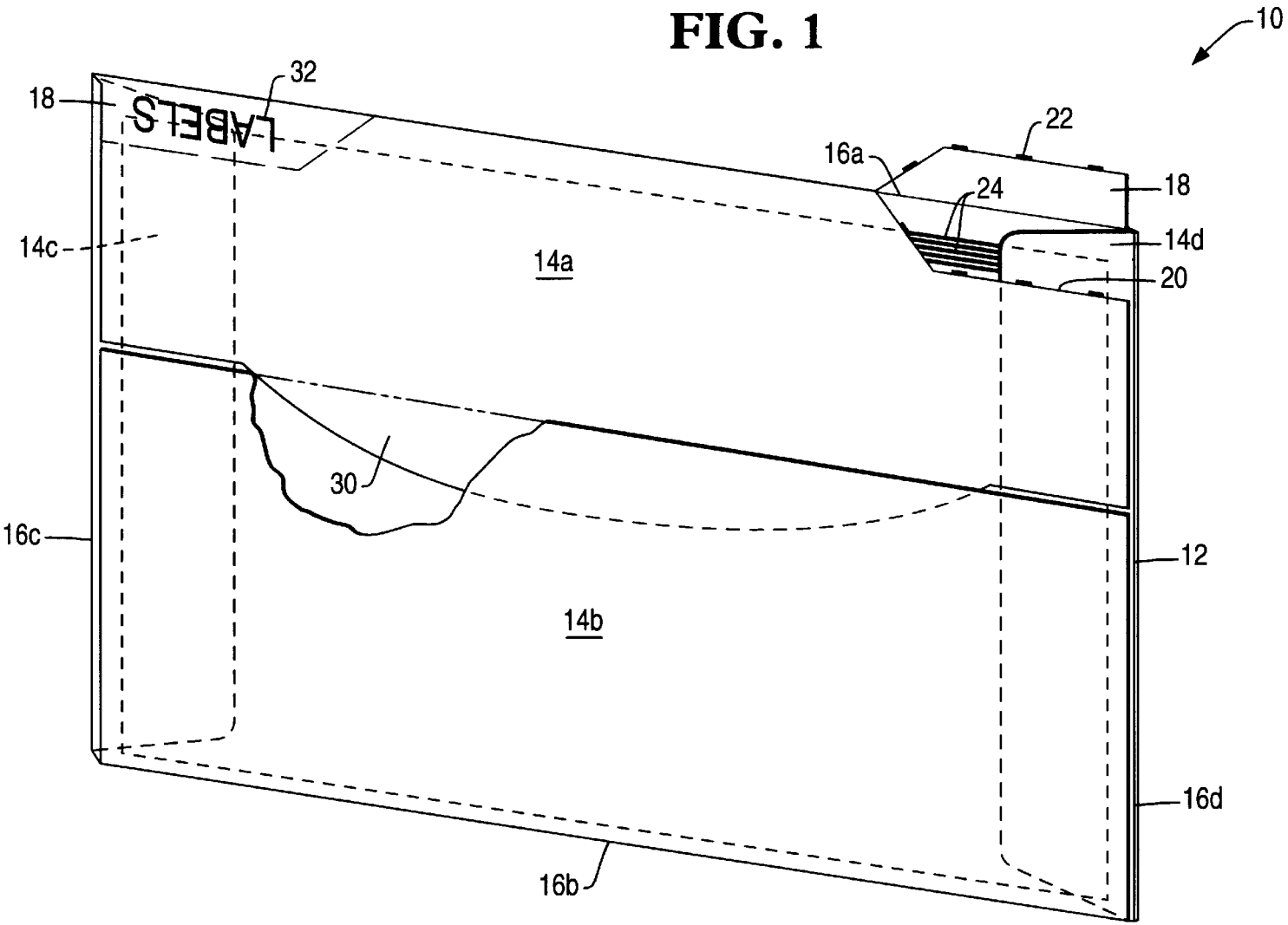
FIG. 1 is an elevational isometric view of a storage pouch having a flip-up tab in ccordance with an exemplary embodiment of the present invention.

Illustrated in FIG. 1 is a packaging or storage pouch 10 in accordance with an exemplary embodiment of the present invention in the form of a closed folder or envelope. The pouch 10 includes a main panel or back sheet 12 integrally joined to a top access flap 14*a* along a top fold line 16*a*. The pouch 10 may be made of suitable material such as paper or plastic for example. The panel 12 is preferably flat and rectangular and cooperates with the flat and generally rectangular access flap 14*a* along the common fold line 16*a*.

The pouch also includes a flip-up identification tab 18 integrally joined to one of the panel and access flap at the common fold line 16*a* for permitting pivotal movement of the tab thereat. The tab 18 is preferably pivotable at the fold line 16*a* between a retracted or stowed position contiguous with the panel and flap, and a deployed or flip-up position extending outwardly therefrom.

Figure 2:
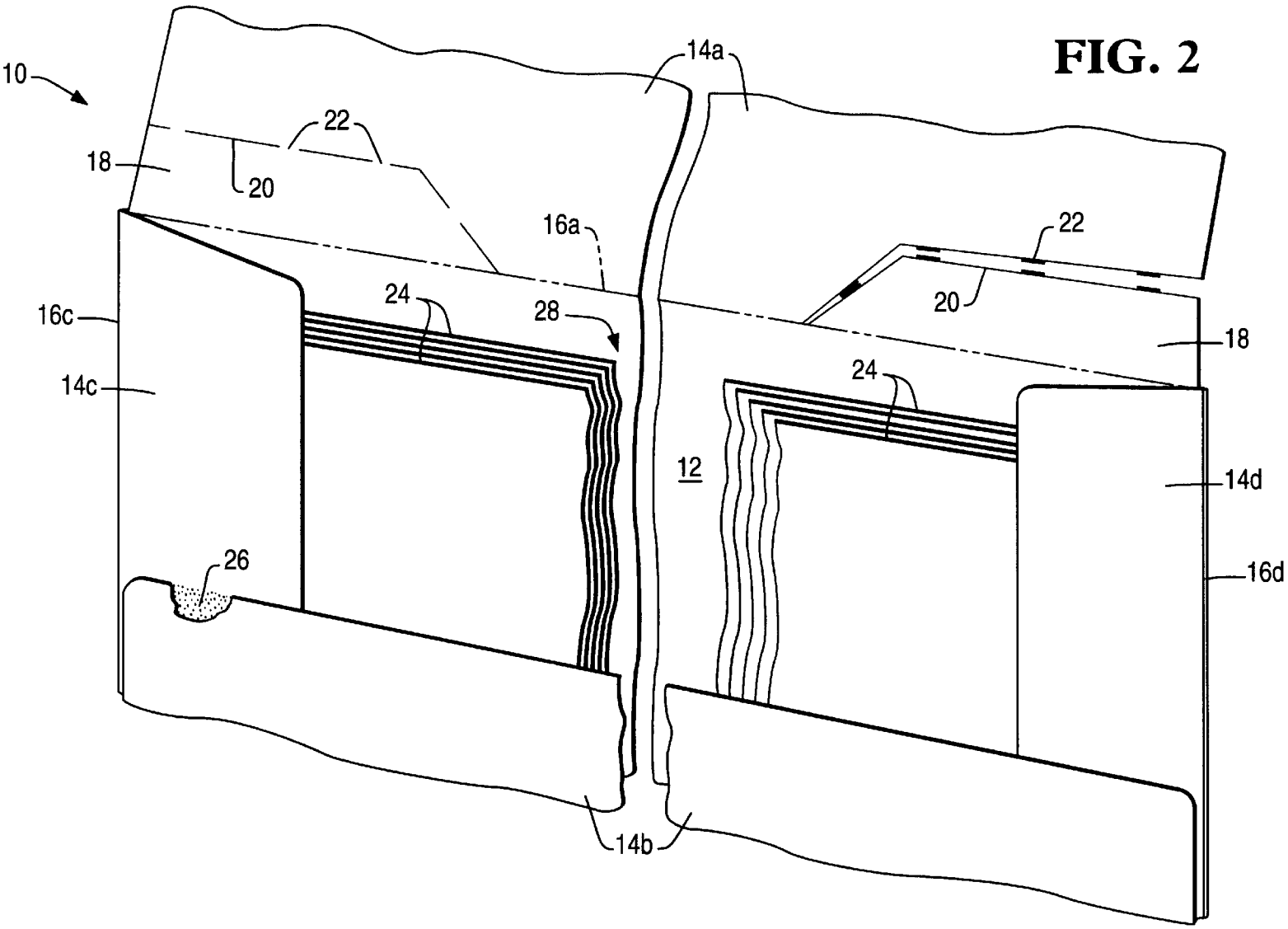
FIG. 2 is an enlarged elevational view of a top portion of the pouch illustrated in FIG. 1 with an open top flap revealing exemplary articles stored therein.

As shown in more detail in FIG. 2, the tab 18 is preferably integrally joined to the panel 12 along the common fold line 16*a*. The access flap 14*a* preferably includes a tab slot 20 adjoining the tab in the stowed position, and being complementary thereto. In this way, the tab 18 initially forms a coplanar portion of the flap 14*a* and is removable therefrom upon displacement from the corresponding tab slot 20. Alternatively, the tab 18 may extend into the panel 12 instead of into the flap if desired.

As shown in FIG. 2, the pouch also includes means in the exemplary form of ties 22 for removably or separably joining together the access flap and tab along the tab slot for maintaining continuity and connection therebetween during the manufacturing and assembly process of the pouch and its contents, and distribution to retail establishments for subsequent purchase by consumers. The joining means may take any suitable form including the ties, or perforation lines for example.

In the preferred embodiment illustrated in FIG. 2, a plurality of integral ties 22 extend between the flap and tab and are spaced apart along the tab slot 20. The slot and ties may be formed during manufacture by simply die cutting the access flap along the outline of the tab slot except at the location of the ties 22 so that the ties maintain continuity of the flap material and provide temporary bridges with the tab 18 for maintaining together the tab and flap.

FIG. 2 illustrates a left tab 18 and unbroken ties 22 which maintain continuity of this tab with the flap 14*a*. An opposite, right tab 18 is also illustrated with the ties 22 being broken for separating or liberating the tab from the flap for allowing flip-up thereof.

The fold line 16*a* illustrated in FIG. 2 extends the full length of the panel 12 and has a pair of opposite left and right ends. One or more of the tabs 18 may be used, and is preferably disposed at one or both of the fold line ends. Accordingly, the tab slot 20 extends inwardly from the side edge of the flap, and upon breaking of the ties 22 the flap and tab are separated from each other out to the edge of the flap, with the slot being open thereat.

Alternatively, the tab may be located inboard of the opposite ends of the flap along the fold line, with the tab slot forming a closed-perimeter aperture within the flap if desired. In this way, one or more of the tabs may be located along the common fold line 16*a* to provide corresponding end-tabs or center-tabs as desired.

As shown in FIGS. 1 and 2, the pouch preferably also includes three additional flaps 14*b,c,d* integrally joined to the panel 12 at respective fold lines 16*b,c,d*. The three additional flaps cooperate with the slotted access flap 14*a* to define a rectangular envelope for storing therein at least one or more articles 24. The articles 24 may have any conventional configuration such as rectangular pressure sensitive label sheets, with the pouch being configured for storing therein up to about twenty-five of the sheet articles stacked together face to face in one example.

In the preferred embodiment illustrated in FIG. 2, three of the four flaps define bond flaps 14*b,c,d* which overlap each other in part, and are bonded together using a suitable adhesive 26 therebetween to define an internal pocket 28 for receiving the articles 24 therein. The fourth, or access flap 14*a* is preferably unbonded to the other flaps and is pivotable at the fold line 16*a* for permitting access into the pocket.

In the preferred embodiment illustrated in FIG. 2, the access flap 14*a* is pivotable on the fold line 16*a* between a fully open position extending outwardly from the panel 12 generally coplanar therewith to expose the pocket 28 therein, and a closed position illustrated in FIG. 1 extending over the panel 12 generally parallel and substantially flat thereatop. In the flap closed position, the articles 24 are sandwiched between the panel 12 on one side thereof and the two flaps 14*a,b* on the opposite side thereof.

Since the pouch 10 illustrated in FIGS. 1 and 2 has four flaps, the tab 18 may be disposed in any one or more of the three bond flaps 14*b,c,d* or the access flap 14*a* or in the main panel 12, as the intended use of the pouch dictates.

In the preferred embodiment illustrated in FIGS. 1 and 2, the tab 18 is disposed in the access flap 14*a*, and the access flap and tab are independently pivotable upon separation of the ties 22 so that the tab may be flipped up during use for identifying the pouch when placed inside a file cabinet drawer sandwiched between adjacent files or file folders.

For example, the panel 12 has a rectangular perimeter defined by the corresponding four fold lines 16*a–d* of the access flap 14*a* and three bond flaps 14*b–d*. The access flap 14*a* defines a vertically top flap of the pouch. One of the bond flaps 14*b* defines a bottom flap of the pouch. And, the two remaining bond flaps 14*c,d* define two side flaps of the pouch.

The four fold lines 16*a–d* define four corresponding edges of the pouch when the respective flaps are closed atop the panel 12. The panel is preferably longer along the top and bottom flaps 14*a,b* than along the two side flaps 14*c,d* to define a rectangular pocket 28 in which correspondingly rectangular articles 24 may be stored. For example, standard label sheets in an 8.5×11 inch (22×28 cm) rectangular configuration may be packaged and stored in the pouch having a 9.2×12 inch (23×30 cm) rectangular configuration.

In the exemplary embodiment illustrated in FIGS. 1 and 2, the top and bottom flaps 14*a,b* are collectively coextensive with the panel 12 when closed. These flaps have the same length, but each has a width narrower than the vertical width of the panel for separately overlapping the corresponding side flaps 14*c,d* while adjoining each other thereat.

The top flap 14*a* preferably includes an integral, center lip 30 as illustrated in FIG. 1 which projects outwardly therefrom to underlap the bottom flap 14*b* to re-close the pouch without adhesive when desired. The top flap 14*a* may be initially secured to the bottom flap 14*b* by tape or adhesive during the manufacturing process for later allowing the top flap to be opened by a consumer. The projecting lip 30 allows the consumer to re-close the pouch by simply inserting the lip 30 between the top edge of the bottom flap 14*b* and the articles remaining in the pouch.

The consumer may also sever the ties 22 for freeing the tab 18 from the access flap 14*a*, with the tab 18 then being bent upwardly for extending outwardly from the panel 12 and coplanar therewith as a local extension. As shown in FIG. 1, the tab 18 may remain extending vertically upwardly from the panel 12 even after the access flap 14*a* is closed upon inserting the lip 30 behind the bottom flap 14*b*.

Accordingly, when the so closed pouch 10 is stored in a typical file cabinet drawer with the flip-up tab 18 being deployed, the tab 18 will be elevated above the drawer contents to visually identify the pouch and its contents.

More specifically, the tab 18 may be blank for subsequent printing thereon by the consumer. Or, in the preferred embodiment illustrated in FIG. 1, the tab 18 includes a printed indicia 32 thereon identifying the specific articles stored in the pocket 28 of the pouch, such as the label sheets.

Figure 3:
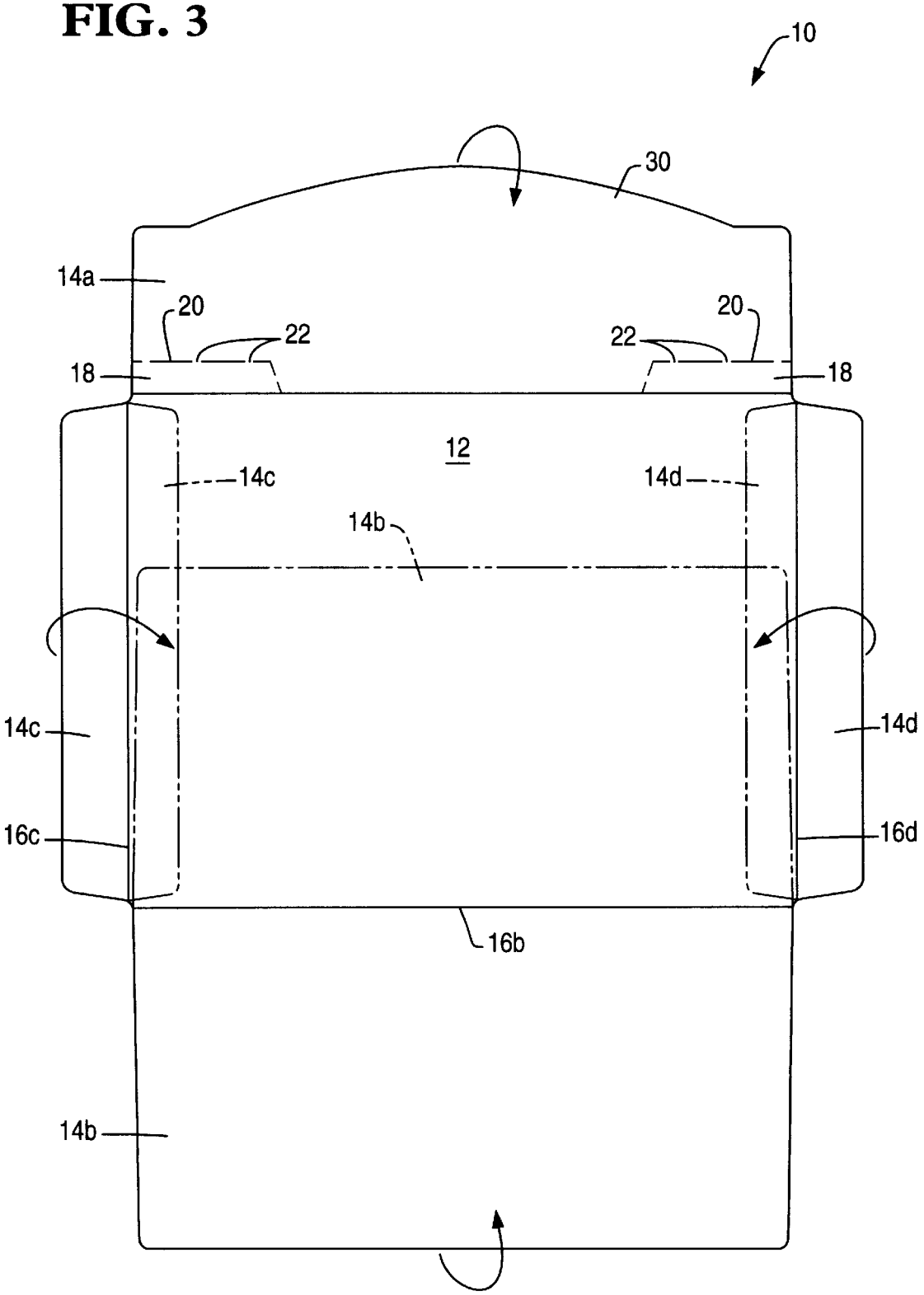
FIG. 3 is a plan view of the pouch illustrated in FIG. 1 having its four flaps open and coplanar with the panel thereof.

A particular advantage of the improved pouch 10 illustrated in FIGS. 1 and 2 is that the flip-up tab may be readily formed in the pouch 10 itself without requiring manually affixed tabs by the consumer after purchase. The panel 12, flaps 14*a–d*, and the tab 18 are preferably a unitary, one-piece construction made from a single sheet of material. FIG. 3 illustrates the initial pouch 10 as cut from a single sheet of material with a suitable flat profile which may be folded to create the resulting pouch illustrated in FIGS. 1 and 2.

The four flaps 14*a–d* are initially laterally extending projections of the common panel 12 integrally joined thereto at the respective fold lines 16*a–d*. The fold lines are conventionally made by scoring or indenting the sheet material therealong. One or more of the tabs 18 may be formed in the access flap 14*a* by suitably die cutting the flap along the corresponding portions thereof to define the tab slots 20 with the intervening ties 22.

Both side flaps 14*c,d* may then be folded flat atop the corresponding edges of the panel 12 as illustrated in phantom in FIG. 3, followed in turn by folding the bottom flap 14*b* upwardly and flat atop the prefolded side flaps 14*c,d*. The adhesive is applied between the side flaps and the bottom flap for forming a permanent bond therewith to define the inside pocket.

The article sheets may then be inserted into the pocket, followed in turn by folding closed the access flap 14*a* which is then suitably taped or bonded to the bottom flap 14*b*. The tabs 18 remain secured to the access flap 14*a* as it is closed and attached to the bottom flap. In this way, a sealed pouch may be provided to a retail establishment for purchase by consumers who may then open the access flap 14*a* and sever the ties 22 for deploying the identifying tab 18.

Figure 4:
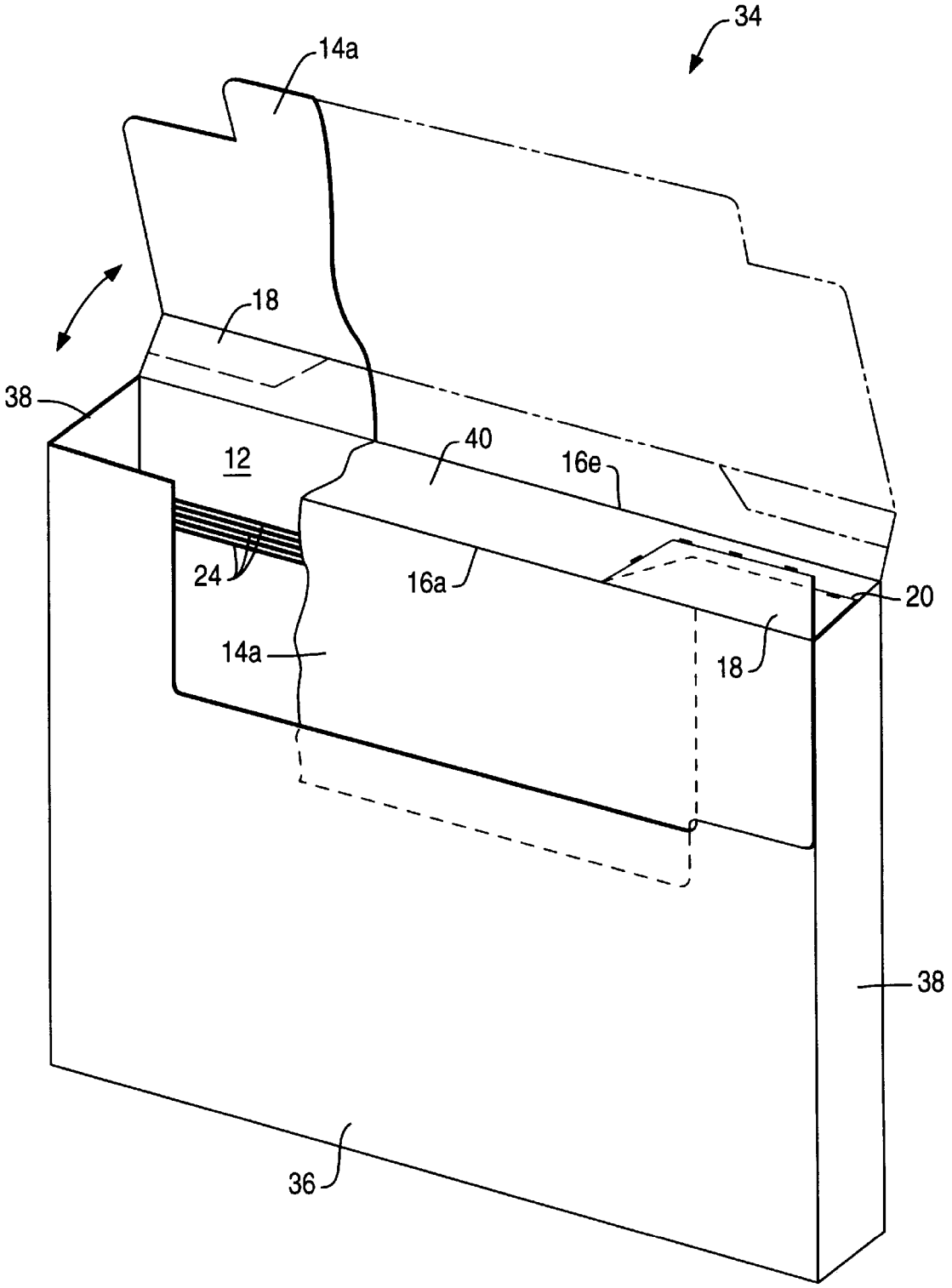
FIG. 4 is an elevational isometric view of a storage pouch in box form having a flip-up tab in accordance with another embodiment of the present invention.

FIG. 4 illustrates another embodiment of the pouch, designated 34, in box form. The pouch includes a second panel 36 spaced from the main panel 12, which defines a first panel, by two identical side panels 38 integrally joined together to define a rectangular box for storing therein one or more articles 24.

In this embodiment, the flip-up tab 18 may be disposed along either top edge of the box. For example, the first panel 12 includes an intermediate fold line 16*e* which is coplanar with the two top edges of the side panels to define an inlet of the box. The first panel also extends outwardly from the intermediate fold line to the flap fold line at the flap to define a box top 40 for closing the box inlet upon pivoting of the flap and top about the two fold lines 16*a,e*.

Either the first panel 12 or the second panel 36 may be used as front or back panels of the box pouch as desired. And the tab 18 may be located at either fold line 16*a,e* for flip-up identification.

The flip-up tabs 18 in both embodiments disclosed above may provide a convenient manner for identifying the contents of the pouch when hidden among files in a file drawer, since the tabs extend vertically upwardly thereabove for visual identification in the same manner as conventionally used file tabs. The integral tabs 18 provide convenient identification of the pouch without requiring the user to use or apply conventional forms of tabs for this purpose.

And, since the pouch requires only a single tab, the liberation of that tab from the access flap 14*a* does not appreciably diminish the integrity or strength of the access flap for undergoing repeated opening and closing thereof as articles are removed from the pouch during its useful life. The access flap may be opened and closed independently of the flip-up tab 18, which itself remains deployed once liberated from the access flap.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

What is claimed is:

1. A retail sales packaging pouch for offering for sale a plurality of stationery articles comprising:

top, bottom, and opposite side flaps integrally joined to a main panel at corresponding fold lines;

said bottom and side flaps being joined together atop said main panel to define a pocket for storing said articles;

said top flap being complementary with said bottom flap and adjoining each other to collectively coextend with said panel;

said top flap including a lip sized to underlap said bottom flap; and a tab integrally joined to one of said panel and flaps along a corresponding one of said fold lines for permitting pivotal movement of said tab thereat.

2. A pouch according to claim 1 wherein said tab is pivotable at said corresponding fold line between a stowed position contiguous with said panel and corresponding flap, and a deployed position extending outwardly therefrom.

3. A pouch according to claim 2 wherein said tab is integrally joined to said panel along said corresponding fold line.

4. A pouch according to claim 3 wherein said flap includes a tab slot adjoining said tab in said stowed position, and being complementary thereto.

5. A pouch according to claim 4 further comprising means for separably joining together said corresponding flap and tab along said tab slot.

6. A pouch according to claim 5 wherein said joining means comprise a plurality of integral ties extending between said corresponding flap and tab, and spaced apart along said tab slot.

7. A pouch according to claim 6 wherein said corresponding fold line has a pair of opposite ends, and said tab is disposed at one of said ends.

8. A pouch according to claim 7 wherein said flaps are directly joined to said panel at said respective fold lines to define a rectangular envelope for storing therein said articles.

9. A pouch according to claim 8 wherein said bottom and side flaps comprise three bond flaps overlapping each other in part, and bonded together to define said pocket for receiving said articles, and said top flap defines an access flap being pivotable at said fold line therefor for permitting access into said pocket.

10. A pouch according to claim 9 wherein said panel, flaps, and tab comprise a unitary construction.

11. A pouch according to claim 9 wherein said tab is disposed in one of said three bond flaps.

12. A pouch according to claim 9 wherein said tab is disposed in said access flap.

13. A pouch according to claim 12 wherein said access flap is pivotable on said fold line therefor between a closed position over said panel, and an open position extending outwardly therefrom.

14. A pouch according to claim 13 wherein said access flap and tab are independently pivotable upon separation of said ties.

15. A pouch according to claim 9 wherein said panel is longer along said top and bottom flaps than along said two side flaps.

16. A pouch according to claim 9 wherein said lip is bondless.

17. A pouch according to claim 9 wherein said tab includes a printed indicia thereon identifying said articles in said pocket.

18. A pouch according to claim 7 wherein said side flaps define two side panels disposed perpendicularly to said main panel and bottom flap to define a rectangular box for storing therein said articles.

19. A pouch according to claim 18 wherein:

said main panel includes an intermediate fold line coplanar with top edges of said side panels to define an inlet of said box;

said main panel extends outwardly from said intermediate fold line to said fold line at said top flap to define a box top for closing said box inlet upon pivoting of said top flap and box top about said fold lines; and said tab is disposed at said fold line joining said top flap and box top.

20. A method of using said pouch according to claim 6 comprising:

inserting said articles in said pouch;

affixing closed said top flap with said bottom flap, with said tab being fixedly joined to said corresponding flap, to seal said articles in said pouch;

opening said top flap to permit access to said articles in said pouch;

severing said ties after opening said top flap; and deploying said tab outwardly from said panel.

21. A method according to claim 20 further comprising re-closing said pouch by folding said top flap along said bottom flap and inserting said lip inside said bottom flap.

* * * * *